US007005043B2

(12) United States Patent
Toney et al.

(10) Patent No.: US 7,005,043 B2
(45) Date of Patent: Feb. 28, 2006

(54) METHOD OF FABRICATION OF A DRYER FABRIC AND A DRYER FABRIC WITH BACKSIDE VENTING FOR IMPROVED SHEET STABILITY

(75) Inventors: Mary M. Toney, Wrentham, MA (US); Maurice Paquin, Plainville, MA (US)

(73) Assignee: Albany International Corp., Albany, NY (US)

( * ) Notice: Subject to any disclaimer, the term of this patent is extended or adjusted under 35 U.S.C. 154(b) by 13 days.

(21) Appl. No.: 10/334,212

(22) Filed: Dec. 31, 2002

(65) Prior Publication Data

US 2004/0126545 A1 Jul. 1, 2004

(51) Int. Cl.

| | |
|---|---|
| ***D21F 1/10*** | (2006.01) |
| ***D21F 7/12*** | (2006.01) |
| ***B32B 27/12*** | (2006.01) |
| ***B05D 1/40*** | (2006.01) |

(52) U.S. Cl. ..... 162/361; 162/348; 162/358.2; 162/902; 428/196; 428/339; 442/71; 442/76; 442/148; 34/116; 34/123; 427/510; 427/513; 427/244; 427/261; 427/265; 427/288; 427/389.9

(58) Field of Classification Search ..... 162/203–207, 162/306, 348, 358.2, 358.4, 900–904, 109–117, 162/361; 156/459–460; 428/192–194, 195.1, 428/198, 200, 206, 212, 213, 220, 143, 147, 428/196, 332, 339; 442/59, 76, 148, 71; 474/226–268; 427/9, 447, 448, 466, 470, 427/487, 492, 508–510, 513, 140, 176, 189, 427/195, 196, 201, 203, 209, 210, 244, 259, 427/261, 265, 285, 288, 331, 355, 370, 372.2, 427/384, 389.9, 394; 34/116, 123

See application file for complete search history.

(56) References Cited

U.S. PATENT DOCUMENTS 3,042,568 A 7/1962 Ludowici et al. ..... 156/137

(Continued)

FOREIGN PATENT DOCUMENTS

| | | |
|---|---|---|
| DE | 196 51 557 | 6/1998 |
| EP | 0 487 477 | 5/1992 |
| EP | 0 568 509 | 11/1993 |

(Continued)

OTHER PUBLICATIONS

S. Ashley, Rapid Prototyping Systems, *Mechanical Engineering*, Apr. 1991, pp. 34-43.

*Primary Examiner*—Eric Hug
(74) *Attorney, Agent, or Firm*—Frommer Lawrence & Haug LLP; Ronald R. Santucci

(57) ABSTRACT

A method of manufacturing and a papermaker's or industrial fabric, such as a dryer fabric for the dryer section of a paper machine, includes the application of a polymeric resin material onto preselected locations on the backside of a base substrate using a piezojet array which deposits the polymeric resin material in droplets having an average diameter of 10$\mu$ (10 microns) or more to build up discrete, discontinuous deposits of the polymeric resin material having a height of about 0.5 mm at the preselected locations. The preselected locations may be the knuckles formed by the interweaving of the yarns making up the fabric. The purpose of the deposits is to separate the backside of the dryer fabric from a surface, such as that of a dryer cylinder or turning roll, to enable air trapped between the dryer fabric and the surface to escape in lengthwise and crosswise directions parallel to the surface, instead of being forced through the fabric, possibly causing "drop off". The polymeric resin material is set by means appropriate to its composition, and, optionally, and, if necessary, may be abraded to provide the deposits with a uniform height above the surface plane of the base substrate.

28 Claims, 6 Drawing Sheets

U.S. PATENT DOCUMENTS

| | | | | | |
|---|---|---|---|---|---|
| 3,149,003 | A | | 9/1964 | Christie et al. | |
| 3,175,792 | A | * | 3/1965 | Smallian | 245/8 |
| 3,350,260 | A | | 10/1967 | Johnson | 162/116 |
| 3,501,366 | A | | 3/1970 | Bramley et al. | |
| 3,549,742 | A | | 12/1970 | Benz | |
| 3,613,258 | A | | 10/1971 | Jamieson | 34/95 |
| 3,673,023 | A | | 6/1972 | Ross | 156/137 |
| 3,720,578 | A | | 3/1973 | Heling et al. | |
| 3,994,662 | A | | 11/1976 | Bramley | |
| 4,109,543 | A | | 8/1978 | Foti | 74/231 |
| 4,111,634 | A | | 9/1978 | Limbach et al. | |
| 4,187,618 | A | | 2/1980 | Diehl | 34/243 |
| 4,191,609 | A | | 3/1980 | Trokhan | 162/113 |
| 4,239,065 | A | | 12/1980 | Trokhan | 139/383 |
| 4,251,928 | A | | 2/1981 | Rotar et al. | 34/116 |
| 4,300,982 | A | * | 11/1981 | Romanski | 162/358.2 |
| 4,312,009 | A | | 1/1982 | Lange | 346/140 |
| 4,382,987 | A | | 5/1983 | Smart | 428/212 |
| 4,383,495 | A | | 5/1983 | Plichta et al. | 118/406 |
| 4,395,308 | A | * | 7/1983 | Dawes | 162/232 |
| 4,427,734 | A | | 1/1984 | Johnson | 428/234 |
| 4,482,430 | A | | 11/1984 | Majaniemi | 162/358 |
| 4,514,345 | A | * | 4/1985 | Johnson et al. | 264/425 |
| 4,528,239 | A | | 7/1985 | Trokhan | 428/247 |
| 4,529,480 | A | | 7/1985 | Trokhan | 162/109 |
| 4,567,077 | A | | 1/1986 | Gauthier | 428/114 |
| 4,571,798 | A | | 2/1986 | Adams | |
| 4,637,859 | A | | 1/1987 | Trokhan | 162/109 |
| 4,752,519 | A | * | 6/1988 | Boyer et al. | 428/137 |
| 4,917,937 | A | | 4/1990 | Lappanen et al. | |
| 4,981,745 | A | * | 1/1991 | Lefkowitz | 428/147 |
| 5,066,532 | A | | 11/1991 | Gaisser | 428/137 |
| 5,084,326 | A | * | 1/1992 | Vohringer | 428/194 |
| 5,136,515 | A | | 8/1992 | Helinski | 364/468 |
| 5,238,537 | A | | 8/1993 | Dutt | 162/358.4 |
| 5,240,531 | A | | 8/1993 | Toda et al. | 156/137 |
| 5,277,761 | A | | 1/1994 | Van Phan et al. | 162/109 |
| 5,292,438 | A | | 3/1994 | Lee | |
| 5,298,124 | A | | 3/1994 | Eklund et al. | 162/306 |
| 5,360,656 | A | | 11/1994 | Rexfelt et al. | 428/193 |
| 5,397,438 | A | | 3/1995 | Nyberg et al. | 162/207 |
| 5,422,166 | A | | 6/1995 | Fleischer | |
| 5,462,642 | A | | 10/1995 | Kajander | 162/116 |
| 5,506,607 | A | | 4/1996 | Sanders, Jr. et al. | 347/1 |
| 5,515,779 | A | | 5/1996 | Danby | |
| 5,518,680 | A | | 5/1996 | Cima et al. | |
| 5,556,509 | A | | 9/1996 | Trokhan et al. | 162/111 |
| 5,628,876 | A | * | 5/1997 | Ayers et al. | 162/358.2 |
| 5,672,248 | A | | 9/1997 | Wendt et al. | 162/109 |
| 5,679,222 | A | | 10/1997 | Rasch et al. | 162/358.1 |
| 5,713,399 | A | | 2/1998 | Collette et al. | 139/383 |
| 5,714,041 | A | | 2/1998 | Ayers et al. | 162/111 |
| 5,731,059 | A | * | 3/1998 | Smith et al. | 428/192 |
| 5,733,608 | A | | 3/1998 | Kessel et al. | 427/547 |
| 5,740,051 | A | | 4/1998 | Sanders, Jr. et al. | 364/468.26 |
| 5,746,887 | A | | 5/1998 | Wendt et al. | 162/109 |
| 5,787,602 | A | * | 8/1998 | Hsu et al. | 34/116 |
| 5,804,036 | A | | 9/1998 | Phan et al. | |
| 5,817,374 | A | | 10/1998 | Detig et al. | 427/466 |
| 5,817,377 | A | | 10/1998 | Trokhan et al. | |
| 5,829,488 | A | | 11/1998 | Fagerholm et al. | 139/383 |
| 5,849,395 | A | * | 12/1998 | Valentine et al. | 428/195.1 |
| 5,900,122 | A | * | 5/1999 | Huston | 162/348 |
| 6,080,691 | A | | 6/2000 | Lindsay et al. | 422/381 |
| 6,099,781 | A | | 8/2000 | Ampulski | |
| 6,120,642 | A | | 9/2000 | Lindsay et al. | 162/109 |
| 6,136,151 | A | | 10/2000 | Davenport et al. | 162/306 |
| 6,136,157 | A | | 10/2000 | Lindeberg et al. | 204/157.6 |
| 6,193,847 | B1 | | 2/2001 | Trokhan | |
| 6,340,413 | B1 | | 1/2002 | Nilsson et al. | 162/361 |
| 6,344,241 | B1 | * | 2/2002 | Ampulski | 427/286 |
| 6,350,336 | B1 | | 2/2002 | Paquin | 156/93 |
| 6,358,030 | B1 | | 3/2002 | Ampulski | |
| 6,358,594 | B1 | | 3/2002 | Ampulski | |
| 6,398,910 | B1 | | 6/2002 | Burazin et al. | |
| 6,419,795 | B1 | | 7/2002 | Dutt | |
| 2001/0035598 | A1 | | 11/2001 | Ampulski | |
| 2002/0107495 | A1 | | 8/2002 | Chen et al. | |

FOREIGN PATENT DOCUMENTS

| | | |
|---|---|---|
| EP | 0 613 729 | 9/1994 |
| EP | 0 677 612 A2 | 10/1995 |
| GB | 1 053 282 | 5/1963 |
| WO | WO 92/00415 | 1/1992 |
| WO | WO 93/00474 | 1/1993 |
| WO | WO 96/35018 | 1/1996 |
| WO | WO 97/14846 | 4/1997 |
| WO | WO 99/35332 | 7/1999 |
| WO | WO 00/09308 | 2/2000 |
| WO | WO 02/088464 A1 | 11/2002 |
| WO | WO 2004/045834 A1 | 6/2004 |

* cited by examiner

METHOD OF FABRICATION OF A DRYER FABRIC AND A DRYER FABRIC WITH BACKSIDE VENTING FOR IMPROVED SHEET STABILITY

BACKGROUND OF THE INVENTION

1. Field of the Invention

The present invention relates to the papermaking arts. More specifically, the present invention relates to the papermaker's fabrics used on the dryer section of a paper machine, and particularly on a single-run dryer section. Such fabrics are commonly referred to as dryer fabrics.

2. Description of the Prior Art

As is well known to those of ordinary skill in the art, the papermaking process begins with the deposition of a fibrous slurry, that is, an aqueous dispersion of cellulosic fibers, onto a moving forming fabric in the forming section of a paper machine. A large amount of water is drained from the slurry through the forming fabric during this process, leaving a fibrous web on its surface.

The newly formed web proceeds from the forming section to a press section, which includes a series of press nips. The fibrous web passes through the press nips supported by a press fabric, or, as is often the case, between two press fabrics. In the press nips, the fibrous web is subjected to compressive forces which squeeze water therefrom, and which adhere its constituent fibers to one another to turn the fibrous web into a sheet. The water squeezed from the web is accepted by the press fabric or fabrics, and, ideally, does not return to the web.

The web, now a sheet, finally proceeds to a dryer section, which includes at least one series of rotatable dryer drums or cylinders, which are internally heated by steam. The sheet itself is directed in a serpentine path sequentially around each in the series of drums by a dryer fabric, which holds the web closely against the surfaces of at least some of the drums. The heated drums reduce the water content of the sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section at the downstream end of the paper machine.

Referring, now, more specifically to the dryer section, in the dryer section, the dryer cylinders may be arranged in a top and a bottom row or tier. Those in the bottom tier are staggered relative to those in the top tier, rather than being in a strict vertical relationship. As the sheet proceeds through the dryer section, it passes alternately between the top and bottom tiers as it passes first around a dryer cylinder in one of the two tiers, then around a dryer cylinder in the other tier, and so on sequentially through the dryer section.

The top and bottom tiers of dryer cylinders may each be clothed with a separate dryer fabric. In such a situation, the paper sheet being dried passes unsupported across the space, or "pocket", between each dryer cylinder and the next dryer cylinder on the other tier.

In a single tier dryer section, a single row of cylinders along with a number of turning cylinders or rolls may be used. The turning rolls may be solid or vented.

In order to increase production rates and to minimize disturbance to the sheet, single-run dryer sections are used to transport the sheet being dried at high speeds. In a single-run dryer section, a paper sheet is transported by use of a single dryer fabric which follows a serpentine path sequentially about the dryer cylinders in the top and bottom tiers.

It will be appreciated that, in a single-run dryer section, the dryer fabric holds the paper sheet being dried directly against the dryer cylinders in one of the two tiers, typically the top tier, but carries it around the dryer cylinders in the bottom tier. The fabric return run is above the top dryer cylinders. On the other hand, some single-run dryer sections have the opposite configuration in which the dryer fabric holds the paper sheet directly against the dryer cylinders in the bottom tier, but carries it around the top cylinders. In this case, the fabric return run is below the bottom tier of cylinders. In either case, a compression wedge is formed by air carried along by the backside surface of the moving dryer fabric in the narrowing space where the moving dryer fabric approaches a dryer cylinder. The resulting increase in air pressure in the compression wedge causes air to flow outwardly through the dryer fabric. This air flow, in turn, forces the paper sheet away from the surface of the dryer fabric, a phenomenon known as "drop off". "Drop off" can reduce the quality of the paper product being manufactured by causing edge cracks. "Drop off" can also reduce machine efficiency if it leads to sheet breaks.

Many paper mills have addressed this problem by machining grooves into the dryer cylinders or rolls or by adding a vacuum source to those dryer rolls. Both of these expedients allow the air otherwise trapped in the compression wedge to be removed without passing through the dryer fabric, although both are expensive.

In this connection, fabric manufacturers have also employed application of coatings to fabrics to impart additional functionality to the fabric, such as "sheet restraint methods." The importance of applying coatings as a method for adding this functionality to, for example, dryer fabrics, has been cited by Luciano-Fagerholm (U.S. Pat. No. 5,829,488 (Albany), titled, "Dryer Fabric With Hydrophilic Paper Contacting Surface").

Luciano and Fagerholm have demonstrated the use of a hydrophilic surface treatment of fabrics to impart sheet-holding properties while maintaining close to the original permeability. However, this method of treating fabric surfaces, while successful in imparting sheet restraint, enhanced hydrophilicity and durability of the coating is desired. WO Patent 97/14846 also recognizes the importance of sheet restraint methods, and relates to using silicone coating materials to completely cover and impregnate a fabric, making it substantially impermeable. However, this significant reduction in permeability is unacceptable for dryer fabric applications. Sheet restraint is also discussed in U.S. Pat. No. 5,397,438, which relates to applying adhesives on lateral areas of fabrics to prevent paper shrinkage. Other related prior art includes U.S. Pat. No. 5,731,059, which reports using silicone sealant only on the fabric edge for high temperature and anti-raveling protection; and U.S. Pat. No. 5,787,602 which relates to applying resins to fabric knuckles. All of the above referenced patents are incorporated herein by reference.

The present invention is another approach toward a solution to this problem in the form of a dryer fabric having backside vents which permit air trapped in a compression wedge to escape without having to pass through the dryer fabric. The present invention also includes a method for manufacturing the dryer fabric.

SUMMARY OF THE INVENTION

Accordingly, the present invention relates primarily to a dryer fabric, although it may find application in any of the fabrics used in the forming, pressing and drying sections of a paper machine, and in the industrial fabrics used in the manufacture of nonwoven fabrics. As such, the papermaker's or industrial fabric comprises a base substrate which takes the form of an endless loop having a backside and a paper-contacting side. A plurality of discrete, discontinuous deposits of polymeric resin material are disposed at preselected locations on the backside. These deposits have a height, relative to the backside, of at least 0.5 mm so that they may separate the backside from the surface of a dryer cylinder or turning roll by that amount when passing thereround. The deposits allow air trapped between the backside and the surface of the dryer cylinder to escape in both the lengthwise and crosswise directions parallel to the surface rather than through the fabric to alleviate the problem of "drop off".

The preselected locations for the discrete, discontinuous deposits of polymeric resin material may be knuckles formed where the yarns in one direction of the fabric pass over the yarns in the other direction. Alternatively, the preselected locations may be "valleys" between knuckles, an alternative which carries the advantage of bonding two intersecting yarns to one another at their crossing point. Alternatively still, the preselected locations may be two or more consecutive knuckles aligned in the machine or cross-machine direction and the valley or valleys in between. When the preselected locations are aligned in the machine direction, this alternative carries the advantage that it allows improved air channeling. Preferably, the deposits reside only on the knuckles or on the backside surfaces of the yarns, where they would not affect the permeability of the fabric. Further, as the deposits form a sort of discontinuous coating on the backside, they have no effect on its bending properties or on the location of its neutral axis of bending. Finally, by improving the ability of the backside of the fabric to manage air in this manner, rather than through the use of elaborate and complicated weave patterns to provide the backside of the fabric with air channels, the base fabric weave structure used for the base substrate may be provided with other characteristics, such as openness, which would give it higher permeability to improve drying rate, and may be simpler and less costly to manufacture and seam.

The present invention is also a method for manufacturing a papermaker's or industrial fabric, such as a dryer fabric. The method comprises a first step of providing a base substrate for the fabric.

Polymeric resin material is deposited onto preselected locations on the base substrate in droplets having an average diameter of $10\mu$ (10 microns) or more to build up discrete, discontinuous deposits of the polymeric resin material to a height of at least 0.5 mm relative to the surface of the base substrate. At least one piezojet may be used to deposit the polymeric resin material onto the base substrate, although other means for depositing droplets of that size may be known to those of ordinary skill in the art or may be developed in the future. The polymeric resin material is then set or fixed by appropriate means.

The preselected locations may, as stated above, be knuckles formed on the surface of the fabric by the interweaving of its yarns.

Subsequently, the deposits of polymeric resin material may optionally be abraded to provide them with a uniform height over the surface plane of the base substrate.

The present invention will now be described in more complete detail, with frequent reference being made to the figures identified below.

DETAILED DESCRIPTION OF THE PREFERRED EMBODIMENTS

The method for fabricating the papermaker's or industrial fabric of the present invention begins with the provision of a base substrate. Typically, the base substrate is a fabric woven from monofilament yarns. More broadly, however, the base substrate may be a woven, nonwoven or knitted fabric comprising yarns of any of the varieties used in the production of paper machine clothing or industrial fabrics used to manufacture nonwoven articles and fabrics, such as monofilament, plied monofilament, multifilament and plied multifilament yarns. These yarns may be obtained by extrusion from any of the polymeric resin materials used for this purpose by those of ordinary skill in the art. Accordingly, resins from the families of polyamide, polyester, polyurethane, polyaramid, polyolefin and other resins may be used.

Alternatively, the base substrate may be composed of mesh fabrics, such as those shown in commonly assigned U.S. Pat. No. 4,427,734 to Johnson, the teachings of which are incorporated herein by reference. The base substrate may further be a spiral-link belt of the variety shown in many U.S. patents, such as U.S. Pat. No. 4,567,077 to Gauthier, the teachings of which are also incorporated herein by reference.

Moreover, the base substrate may be produced by spirally winding a strip of woven, nonwoven, knitted or mesh fabric in accordance with the methods shown in commonly assigned U.S. Pat. No. 5,360,656 to Rexfelt et al., the teachings of which are incorporated herein by reference. The base substrate may accordingly comprise a spirally wound strip, wherein each spiral turn is joined to the next by a continuous seam making the base substrate endless in a longitudinal direction.

The above should not be considered to be the only possible forms for the base substrate. Any of the varieties of base substrate used by those of ordinary skill in the paper machine clothing and related arts may alternatively be used.

Once the base substrate has been provided, one or more layers of staple fiber batt may optionally be attached to one or both of its two sides by methods well known to those of ordinary skill in the art. Perhaps the best known and most commonly used method is that of needling, wherein the individual staple fibers in the batt are driven into the base substrate by a plurality of reciprocating barbed needles.

Alternatively, the individual staple fibers may be attached to the base substrate by hydroentangling, wherein fine high-pressure jets of water perform the same function as the above-mentioned reciprocating barbed needles. It will be recognized that, once staple fiber batt has been attached to the base substrate by either of these or other methods known by those of ordinary skill in the art, one would have a structure identical to that of a press fabric of the variety generally used to dewater a wet paper web in the press section of a paper machine.

Figure 1:
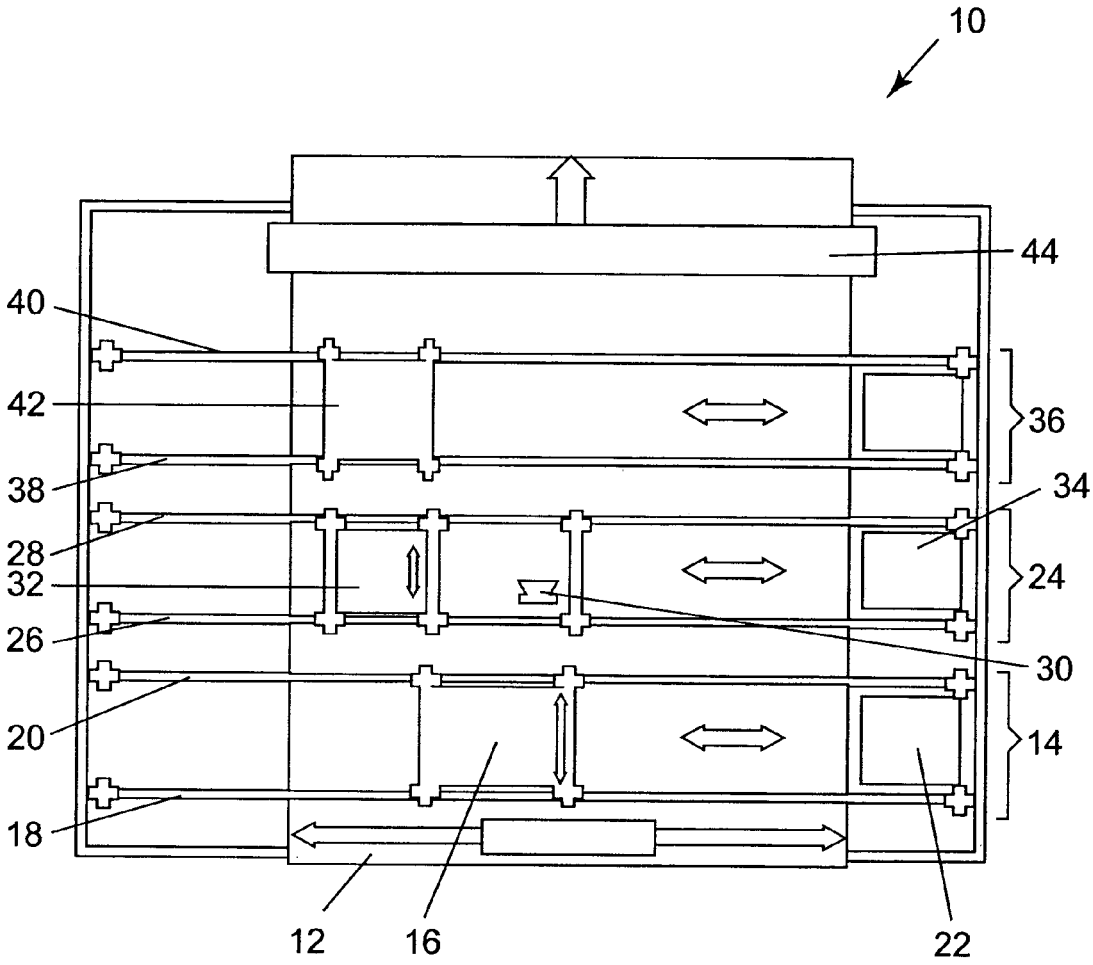
FIG. 1 is a schematic view of an apparatus used to manufacture papermaker's and industrial fabrics according to the method of the present invention.

Once the base substrate, with or without the addition of staple fiber batt material on one or both of its two sides, has been provided, it is mounted on the apparatus 10 shown schematically in FIG. 1, so that polymeric resin material may be deposited on its backside in accordance with the present invention. It should be understood that the base substrate may be either endless or seamable into endless form during installation on a papermachine. As such, the base substrate 12 shown in FIG. 1 should be understood to be a relatively short portion of the entire length of the base substrate 12. Where the base substrate 12 is endless, it would most practically be mounted about a pair of rolls, not illustrated in the figure but most familiar to those of ordinary skill in the paper machine clothing arts. In such a situation, apparatus 10 would be disposed on one of the two runs, most conveniently the top run, of the base substrate 12 between the two rolls. Whether endless or not, however, the base substrate 12 is preferably placed under an appropriate degree of tension during the process. Moreover, to prevent sagging, the base substrate 12 may be supported from below by a horizontal support member as it moves through apparatus 10. It should finally be observed that, where the base substrate 12 is endless, it may be necessary to invert it, that is, to turn it inside out, following the application of polymeric resin material in accordance with the present invention to ensure that the polymeric resin material resides on the backside of the base substrate 12.

Furthermore, for some applications, it may be necessary to apply the resin pattern to the sheet contact side. Also, it is envisioned that the resin application for air control should be applied to both sides of the fabric, either with the same or different patterns.

Referring now more specifically to FIG. 1, where the base substrate 12 is indicated as moving in an upward direction through the apparatus 10 as the method of the present invention is being carried out, apparatus 10 comprises a sequence of several stations through which the base substrate 12 may pass incrementally as a fabric is being manufactured therefrom.

The stations are identified as follows:

1. optional polymer deposition station 14;
2. imaging/precise polymer deposition station 24;
3. optional setting station 36; and
4. optional grinding station 44.

In the first station, the optional polymer deposition station 14, a piezojet array 16 mounted on transverse rails 18,20 and translatable thereon in a direction transverse to that of the motion of the base substrate 12 through the apparatus 10, as well as therebetween in a direction parallel to that of the motion of the base substrate 12, may be used to deposit a polymeric resin material onto or within the base substrate 12 while the base substrate 12 is at rest. Optional polymer deposition station 14 may be used to deposit the polymeric resin material more uniformly over the base substrate than could be accomplished using conventional techniques, such as spraying, if desired.

The piezojet array 16 comprises at least one but preferably a plurality of individual computer-controlled piezojets, each functioning as a pump whose active component is a piezoelectric element. As a practical matter an array of up to 256 piezo jets or more may be utilized if the technology permits. The active component is a crystal or ceramic which is physically deformed by an applied electric signal. This deformation enables the crystal or ceramic to function as a pump, which physically ejects a drop of a liquid material each time an appropriate electric signal is received. As such, this method of using piezojets to supply drops of a desired material repeatedly so as to build up the desired amount of material in the desired shape in response to computer-controlled electric signals is commonly referred to as a "drop-on-demand" method.

The degree of precision of the jet in depositing the material will depend upon the dimensions and shape of the structure being formed. The type of jet used and the viscosity of the material being applied will also impact of the precision the jet selected.

Referring again to FIG. 1, the piezojet array 16, starting from an edge of the base substrate 12, or, preferably, from a reference thread extending lengthwise therein, translates lengthwise and widthwise across the base substrate 12, while the base substrate 12 is at rest, deposits the polymeric resin material in the form of extremely small droplets having a nominal diameter of $10\mu$ (10 microns) or more such as $50\mu$ (50 microns) or $100\mu$ (100 microns), onto the base substrate 12. The translation of the piezojet array 16 lengthwise and widthwise relative to the base substrate 12, and the deposition of droplets of the polymeric resin material from each piezojet in the array 16, are controlled by computer in a controlled manner to apply a desired amount of the polymeric resin material in a controlled geometry in three planes length, width and depth or height (x, y, z dimensions or directions) and in a per unit area of the base structure 12, if desired. In addition the deposit of the material need not only be traversing the movement of the base substrate but can be parallel to such movement, spiral to such movement or in any other manner suitable for the purpose.

In the present invention, in which a piezojet array is used to deposit a polymeric resin material onto or within the surface of the base substrate 12, the choice of polymeric resin material is limited by the requirement that its viscosity be 100 cps (100 centipoise) or less at the time of delivery, that is, when the polymeric resin material is in the nozzle of a piezojet ready for deposition, so that the individual piezojets can provide the polymeric resin material at a constant drop delivery rate. In this regard, the viscosity of the polymeric resin material at the point of delivery in conjunction with the jet size is important in defining the size and shape of the droplets formed on the base substrate 12 and in time the resolution of the pattern ultimately achieved. Another requirement limiting the choice of polymeric resin material is that it must partially set during its fall, as a drop, from a piezojet to the base substrate 12, or after it lands on the base substrate 12, to prevent the polymeric resin material from flowing and to maintain control over the polymeric resin material to ensure that it remains in the form of a drop where it lands on the base substrate 12. Suitable polymeric resin materials which meet these criteria and which are preferably abrasion resistant are:

1. Hot melts and moisture-cured hot melts;
2. Two-part reactive systems based on urethanes and epoxies;

3. Photopolymer compositions consisting of reactive acrylated monomers and acrylated oligomers derived from urethanes, polyesters, polyethers, and silicones; and
4. Aqueous-based latexes and dispersions and particle-filled formulations including acrylics and polyurethanes.

It should be understood that the polymeric resin material needs to be fixed on or within the base substrate 12 following its deposition thereon. The means by which the polymeric resin material is set or fixed depends on its own physical and/or chemical requirements. Photopolymers are cured with light, whereas hot-melt materials are set by cooling. Aqueous-based latexes and dispersions are dried and then cured with heat, and reactive systems are cured by heat. Accordingly, the polymeric resin materials may be set by curing, cooling, drying or any combination thereof.

The proper fixing of the polymeric resin material is required to control its penetration into and distribution within the base substrate 12, that is, to control and confine the material within the desired volume of the base substrate 12. Such control is important below the surface plane of the base substrate 12 to prevent wicking and spreading. Such control may be exercised, for example, by maintaining the base substrate 12 at a temperature which will cause the polymeric resin material to set quickly upon contact. Control may also be exercised by using such materials having well-known or well-defined curing or reaction times on base substrates having a degree of openness such that the polymeric resin material will set before it has time to spread beyond the desired volume of the base substrate 12.

Figure 7:
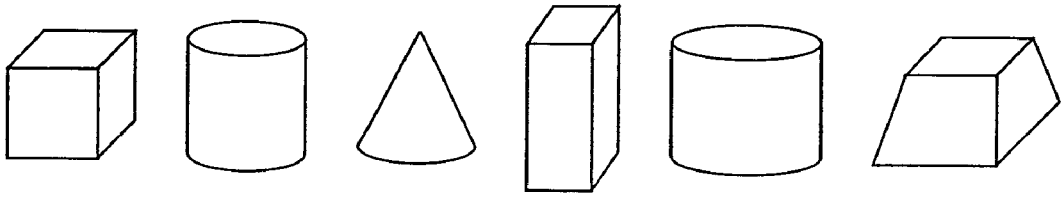
FIG. 7 is a perspective view of a variety of representative shapes of the deposited material.

One or more passes over the base substrate 12 may be made by piezojet array 16 to deposit the desired amount of material and to create the desired shape. In this regard, the deposits can take any number of shapes as illustrated generally in FIG. 7. The shapes can be square, round conical, rectangular, oval, trapezoidal etc. with a thicker base tapering upward. Depending upon the design chosen, the amount of material deposited can be layered in decreasing fashion as the jet repeatedly passes over the deposit area.

When a desired amount of polymeric resin material has been applied per unit area in a band between the transverse rails 18,20 across the base substrate 12, the base substrate 12 is advanced lengthwise an amount equal to the width of the band, and the procedure described above is repeated to apply the polymeric resin material in a new band adjacent to that previously completed. In this repetitive manner, the entire base substrate 12 can be provided with any desired amount of polymeric resin material per unit area.

Alternatively, the piezojet array 16, again starting from an edge of the base substrate 12, or, preferably, from a reference thread extending lengthwise therein, is kept in a fixed position relative to the transverse rails 18,20, while the base substrate 12 moves beneath it, to apply any desired amount of the polymeric resin material per unit area in a lengthwise strip around the base substrate 12. Upon completion of the lengthwise strip, the piezojet array 16 is moved widthwise on transverse rails 18,20 an amount equal to the width of the lengthwise strip, and the procedure described above is repeated to apply the polymeric resin material in a new lengthwise strip adjacent to that previously completed. In this repetitive manner, the entire base substrate 12 can be provided with the desired amount of polymeric resin material per unit area, if desired.

Note the pattern can be random, a repeating random pattern on a base substrate or such patterns that are repeatable from belt to belt for quality control.

At one end of the transverse rails 18,20, a jet check station 22 is provided for testing the flow of polymeric resin material from each piezojet in the piezojet array 16. There, the piezojets can be purged and cleaned to restore operation automatically to any malfunctioning piezojet unit.

In the second station, the imaging/precise polymer deposition station 24, the only station not optional in the present invention, transverse rails 26,28 support a digital-imaging camera 30, which is translatable across the width of base substrate 12, and a piezojet array 32, which is translatable both across the width of the base substrate 12 and lengthwise relative thereto between transverse rails 26,28, while the base substrate 12 is at rest.

The digital-imaging camera 30 views the surface of the base substrate 12 to locate the knuckles formed where the yarns in one direction of the base substrate 12 weave over those in the other direction. In the weaving process these cross-over points, while being located very close to predetermined or regular intervals, depending upon the weave pattern, do, however, vary. Accordingly, merely attempting to deposit the polymeric resin material at discrete intervals will not insure that all, or the desired number of cross-over points will receive the deposit. Accordingly, a comparison between the actual surface and its desired appearance are made by a fast pattern recognizer (FPR) processor operating in conjunction with the digital-imaging camera 30 in real time. The FPR processor signals the piezojet array 32 to deposit polymeric resin material onto the locations requiring it to match the desired appearance. In the present invention, the polymeric resin material is deposited onto the knuckles on the backside of the fabric to build up discrete, discontinuous deposits of the polymeric resin material thereon. Alternatively, it is deposited onto valleys between knuckles, or onto two or more consecutive knuckles aligned in the machine or cross-machine direction and onto the valleys in between. Essentially, the deposits are provided to separate the backside of the fabric from a dryer cylinder or turning roll so that air, carried by the backside of the fabric into a compression wedge, can escape in both the lengthwise and crosswise directions along the surface of the backside instead of being forced through the fabric, where it would cause "drop off". Ideally, the deposits are built up gradually through the deposition of droplets of polymeric resin material from the piezojets in multiple passes by piezojet array 32 to attain a height above the knuckle in a nominal range from 0.5 mm to 1.0 mm, so as to separate the backside of the fabric from a dryer cylinder or turning roll by that amount. Multiple passes by piezojet array 32 allow the shapes of the deposits to be carefully controlled so as not to affect the permeability of the dryer fabric. That is to say by depositing the droplets in a repeating pattern, that being by layering one droplet on the top of the next, the height or z-direction of the polymer resin material on the base substrate 12 is controlled and may be uniform, varied or otherwise adjusted as desired. Further, some of the individual piezojets in the piezojet array may be used to deposit one polymeric resin material, while others may be used to deposit a different polymeric resin material, to produce a surface having microregions of more than one type of polymeric resin material. Such accuracy in depositing may avoid the step of grinding or abrading to obtain a monoplanar surface across the polymeric resin material deposited. Of course, a grinding or abrading step may also be done, if so desired.

As in optional polymer deposition station 14, a piezojet check station 34 is provided at one end of the transverse rails 26,28 for testing the flow of material from each piezojet. There, each piezojet in the piezojet array 32 can be purged and cleaned to restore operation automatically to any malfunctioning piezojet unit.

In the third station, the optional setting station 36, transverse rails 38,40 support a setting device 42, which may be required to set the polymeric resin material being used. The setting device 42 may be a heat source, for example, an infrared, hot air, microwave or laser source; cold air; or an ultraviolet or visible-light source, the choice being governed by the requirements of the polymeric resin material being used.

Finally, the fourth and last station is the optional grinding station 44, where an appropriate abrasive is used to provide any polymeric resin material above the surface plane of the base substrate 12 with a uniform thickness. The optional grinding station 44 may comprise a roll having an abrasive surface, and another roll or backing surface on the other side of the base substrate 12 to ensure that the grinding will result in a uniform thickness.

Figure 2:
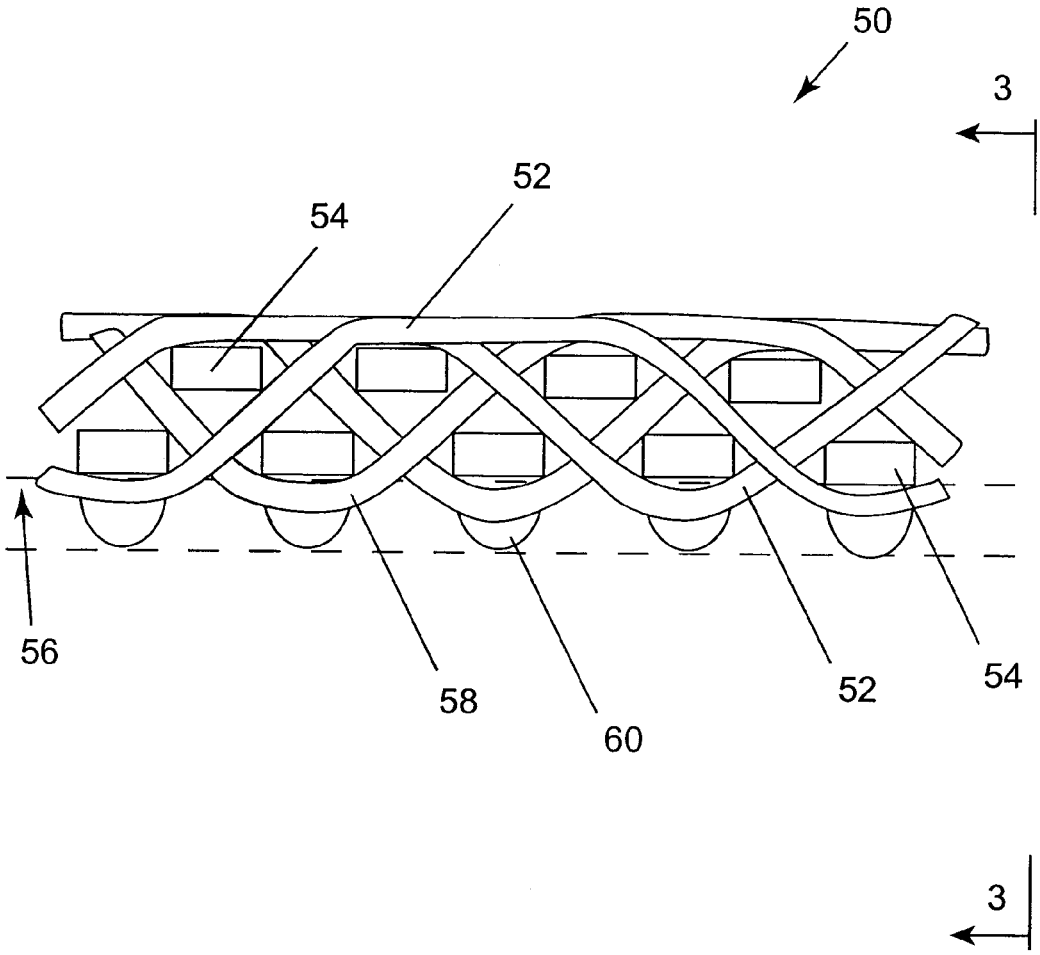
FIG. 2 is a cross-sectional view, taken in a lengthwise direction, of a dryer fabric of the present invention.

As an example, reference is now made to FIG. 2, which is a cross-sectional view, taken in a lengthwise direction, of a dryer fabric 50 having polymeric resin material deposited on the knuckles on its backside surface to form discrete, discontinuous deposits 60 thereof in accordance with the present invention. The dryer fabric 50 is woven from lengthwise yarns 52 and crosswise yarns 54 in a duplex weave, although it should be understood that the particular weave shown is an example to which the present invention is not limited.

Figure 3:
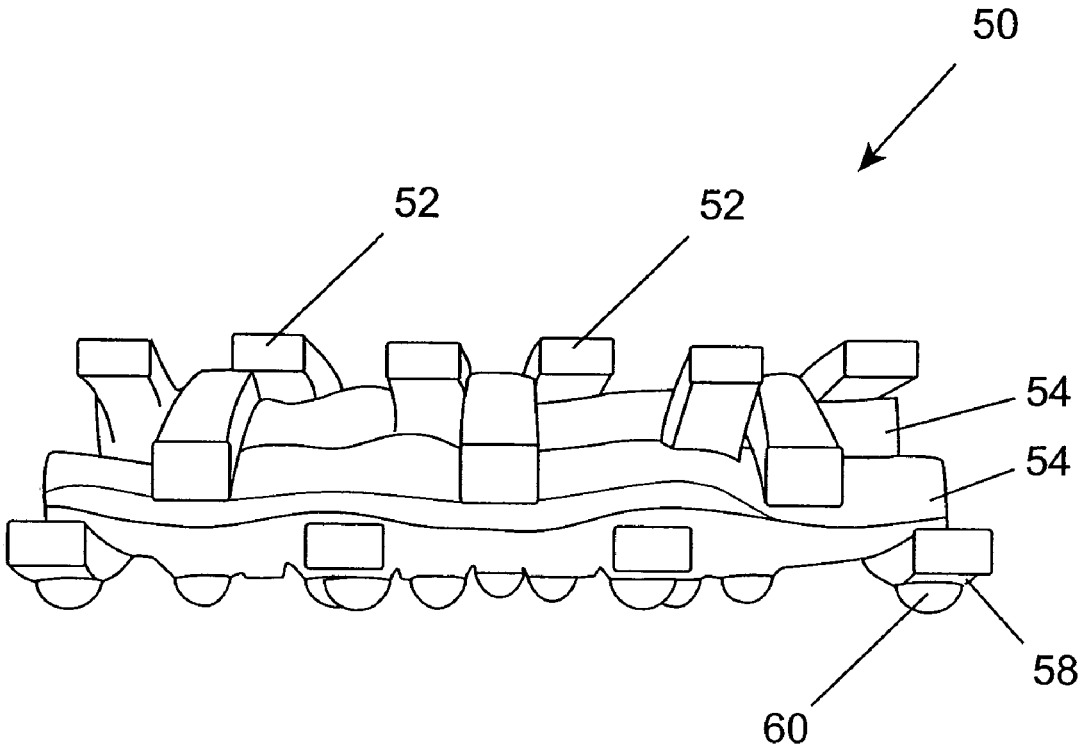
FIG. 3 is a cross-sectional view of the dryer fabric taken in the crosswise direction thereof as indicated in FIG. 2.

FIG. 3 is a cross-sectional view taken in the crosswise direction as indicated in FIG. 2. As shown in FIGS. 2 and 3, lengthwise yarns 52 and crosswise yarns 54 are both of rectangular cross section, but this too should be understood to be an example to which the present invention is not limited.

The backside 56 of the dryer fabric 50 is the underside thereof in the views shown in FIGS. 2 and 3. In accordance with the present invention, the knuckles 58 formed where the lengthwise yarns 52 weave under the lower crosswise yarns 54 have discrete, discontinuous deposits 60 of polymeric resin material built up by the deposition of small droplets thereof by imaging/precise polymer deposition station 24. The deposits 60, as can readily be visualized, separate the knuckles 58 from any surface, such as that of a dryer cylinder, and raise the entire dryer fabric 50 relative to such a surface. As indicated by the views presented in FIGS. 2 and 3, the deposits 60 enable air to flow in both the lengthwise and crosswise directions between the backside 56 of the dryer fabric 50 and a dryer cylinder to allow air carried into a compression wedge by the moving dryer fabric 50 to ventilate other than by passing outwardly through the dryer fabric 50. The deposits 60, as stated above, have heights, relative to the knuckles 58 on which they are disposed, in a nominal range from 0.5 mm to 1.0 mm.

Figure 4:
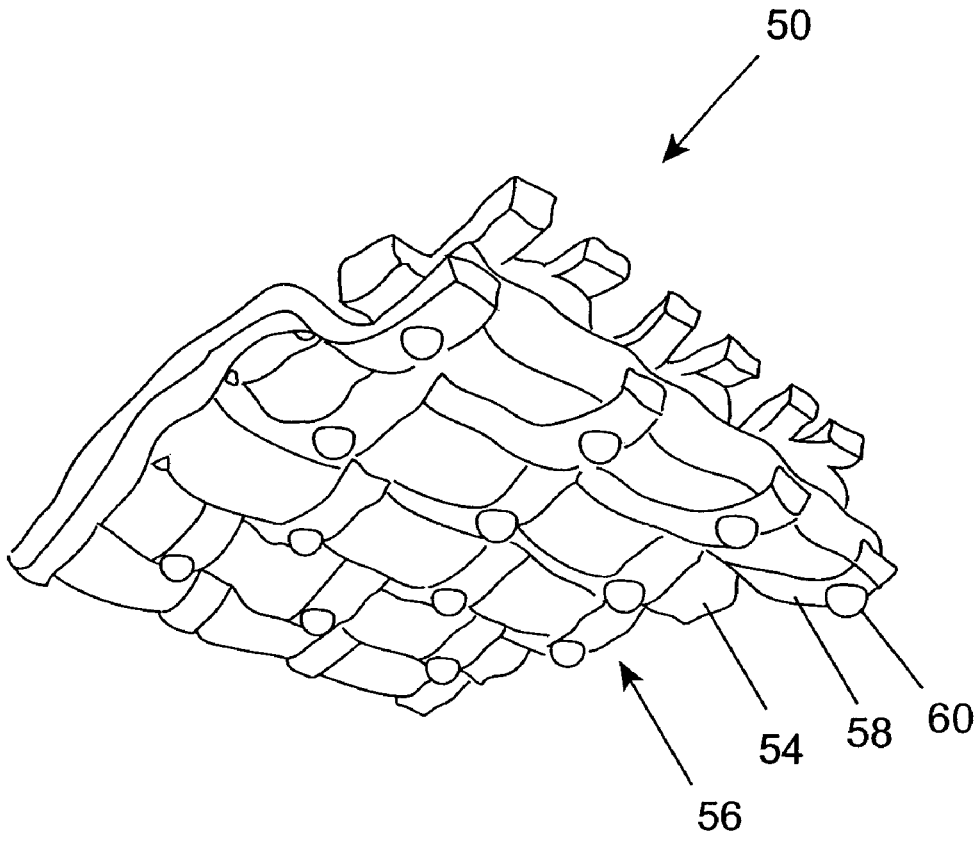
FIG. 4 is a perspective view of the backside of the dryer fabric.

FIG. 4 is a perspective view of the backside 56 of the dryer fabric 50 showing the deposits 60 on the knuckles 58 formed by the lengthwise yarns 52. The knuckles 58 and deposits 60 form twill lines on the backside 56, although those of ordinary skill in the art will realize that such alignment results from the particular weave pattern shown in FIGS. 2 through 4 and is not a necessary characteristic of all dryer fabrics of the present invention. In short, deposits 60 could be applied to the backside of any dryer fabric 50, including those of the spiral-link type, such as that shown in U.S. Pat. No. 4,567,077 to Gauthier, the teachings of which have been incorporated herein by reference above, as a final step in the manufacturing process.

To their advantage, the deposits 60, which, in a sense, form a discontinuous coating on the backside 56 of the dryer fabric 50, have no effect on the bending properties of the dryer fabric 50, as, lying discontinuously on the surface, they affect neither the stiffness of the dryer fabric 50, nor the location of its neutral axis of bending.

In an alternate embodiment of the present invention, the optional polymer deposition station 14, the imaging/repair station 24, and the optional setting station 36 may be adapted to produce a fabric from the base substrate 12 according to a spiral technique, rather than by indexing in the cross-machine direction as described above. In a spiral technique, the optional polymer deposition station 14, the imaging/precise polymer deposition station 24, and the optional setting station 36 start at one edge of the base substrate 12, for example, the left-hand edge in FIG. 1, and are gradually moved across the base substrate 12, as the base substrate 12 moves in the direction indicated in FIG. 1. The rates at which the stations 14,24,36 and the base substrate 12 are moved are set so that the polymeric resin material desired in the finished fabric is spiraled onto the base substrate 12 as desired in a continuous manner. In this alternative, the polymeric resin material deposited by the optional polymer deposition station 14 and imaging/precise polymer deposition station 24 may be partially set or fixed as each spiral passes beneath the optional setting device 42, and completely set when the entire base substrate 12 has been processed through the apparatus 10.

Alternatively, the optional polymer deposition station 14, the imaging/precise polymer deposition station 24 and the optional setting station 36 may all be kept in fixed. positions aligned with one another, while the base substrate 12 moves beneath them, so that the polymeric resin material desired for the finished fabric may be applied to a lengthwise strip around the base substrate 12. Upon completion of the lengthwise strip, the optional polymer deposition station 14, the imaging/precise polymer deposition station 24 and the optional setting station 36 are moved widthwise an amount equal to the width of the lengthwise strip, and the procedure is repeated for a new lengthwise strip adjacent to that previously completed. In this repetitive manner the entire base structure 12 can be completely treated as desired.

It should be noted that the material need not be a full width belt but can be a strip of material such as that disclosed in U.S. Pat. No. 5,360,656 to Rexfelt, the disclosure of which is incorporated herein by reference, and subsequently formed into a full width belt. The strip can be unwound and wound up on a set of rolls after fully processing. These rolls of belting materials can be stored and can then be used to form an endless full width structure using, for example, the teachings of the immediately aforementioned patent.

Figure 5:
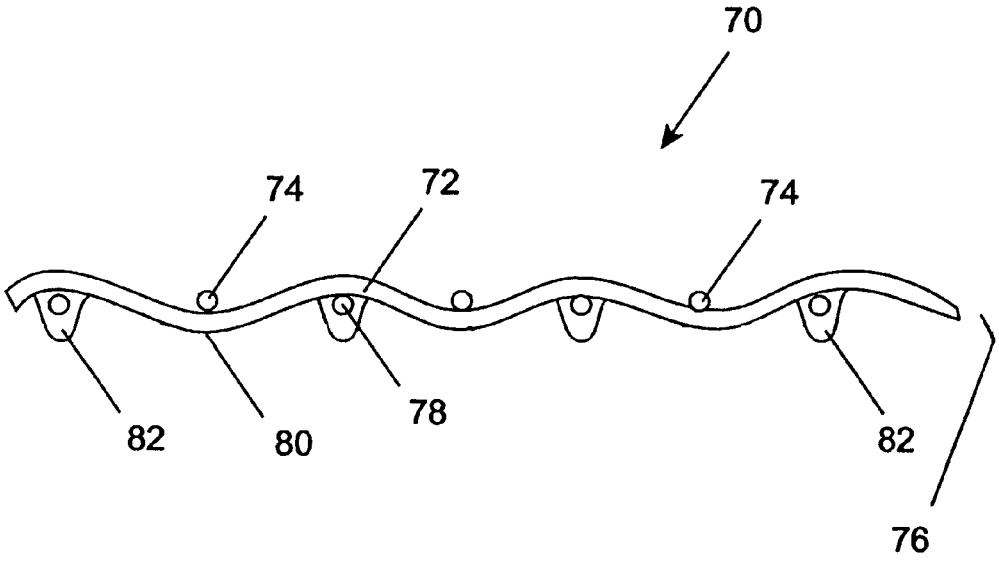
FIG. 5 is a cross-sectional view taken in a lengthwise direction, of an alternate embodiment of the dryer fabric.

FIG. 5 is a cross-sectional view, taken in a lengthwise direction, of a dryer fabric 70 having polymeric resin material deposited on so-called valleys on its backside surface to form discrete, discontinuous deposits thereof in accordance with the present invention. Dryer fabric 70 is woven from lengthwise yarns 72 and crosswise yarns 74 in a plain weave, although it should be understood that the present invention is not limited to such a weave. The backside 76 of the dryer fabric 70 is the underside thereof in the view shown in FIG. 5. In the embodiment shown there, the valleys 78 between knuckles 80 formed where lengthwise yarns 72 weave under crosswise yarns 74 have discrete, discontinuous deposits 82 of polymeric resin material built up by the deposition of small droplets thereof. The deposits 82 separate the backside 76 of the fabric 70 from any surface, such as that of a dryer cylinder or turning roll, and raise the entire dryer fabric 70 relative to such a surface. Deposits 82 also bond lengthwise yarns 72 to crosswise yarns 74 at the crossing points. The deposits 82, as stated above, have heights, relative to the knuckles 80, in a nominal range from 0.5 mm to 1.0 mm.

Figure 6:
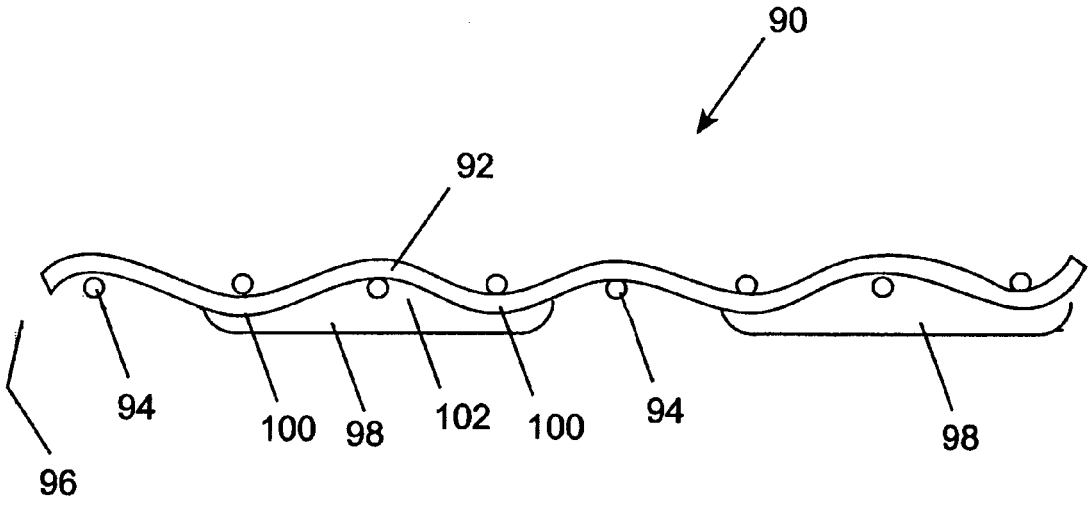
FIG. 6 is a cross-sectional view, also taken in a lengthwise direction, of yet another embodiment of the dryer fabric.

FIG. 6 is a cross-sectional view, taken in a lengthwise direction, of a dryer fabric 90 having polymeric resin material deposited on two consecutive knuckles aligned in the machine direction and on the valleys in between on its backside surface to form discrete, discontinuous deposits thereon. Dryer fabric 90 is woven from lengthwise yarns 92 and crosswise yarns 94 in a plain weave, although it should be understood that the present invention is not limited to such a weave. The backside 96 of the dryer fabric 90 is the underside thereof in the view shown in FIG. 6. In the embodiment shown there, discrete, discontinuous deposits 98 run between adjacent knuckles 100 and cover the valley 102 therebetween on lengthwise yarn 92, knuckles 100 being formed where the lengthwise yarns 92 weave under the crosswise yarns 94. Deposits 98 are built up by the deposit of small droplets of polymeric resin material, and separate the backside 96 of the fabric 90 from any surface, such as that of a dryer cylinder or turning roll, and raise the entire dryer fabric 90 relative to such a surface. Deposits 98 have heights, relative to the knuckles 100, in a nominal range from 0.5 mm to 1.0 mm. While FIG. 6 shows the deposits 98 running only from one knuckle 100 to the next, it should be understood that they could run for any desired length, that is, for any number of knuckles 100 desired.

It should also be understood that, whatever form (e.g. square, rectangle, cylindrical, trapezoid, etc. see FIG. 7) the discrete, discontinuous deposits 60,82,98 take, they need not be applied to every knuckle, valley or otherwise, as the case may be. Rather, they may be spaced from one another by any number of intervening knuckles or valleys in either the machine or cross-machine direction to define desired patterns on the backside of the fabric.

Finally, as stated above, where the base substrate 12 is endless, it may be necessary to invert it, that is, to turn it inside out, to place the discrete, discontinuous deposits of polymeric resin material on the backside thereof, when the apparatus 10 is used to deposit the polymeric resin material on the top run of the base substrate 12 therethrough. Where the base substrate 12 is not endless, the side being given the discrete, discontinuous deposits will ultimately be placed on the inside when the base substrate 12 is seamed into endless form on a dryer section. In either case, as aforesaid, there may be situations where resin is applied to the sheet contact side in addition to the backside. Also, as an alternative, one might consider depositing a sacrificial material in a desired pattern to create in essence a mold for the resin material thereafter deposited. This sacrificial material can be, for example, wax or a water soluble substance which is then removed leaving the resin set in the desired pattern on the fabric.

Also it may be desired to apply different polymeric resin material on the same fabric at different locations by way of different jets in the array.

Modifications to the above would be obvious to those of ordinary skill in the art, but would not bring the invention so modified beyond the scope of the appended claims. In particular, while piezojets are disclosed above as being used to deposit the polymeric resin material in the preselected locations on the base substrate, other means for depositing droplets thereof in the size range desired may be known to those of ordinary skill in the art or may be developed in the future, and such other means may be used in the practice of the present invention. The use of such means would not bring the invention, if practiced therewith, beyond the scope of the appended claims.

What is claimed is:

1. A method for manufacturing a papermaker's or industrial fabric, said method comprising the steps of:

a) providing a base substrate for the fabric;

b) depositing a plurality of polymeric resin material droplets onto preselected discrete locations on said base substrate in a controlled manner to build up discrete, discontinuous elements of said polymeric resin material having a height of about 0.5 mm at said preselected discrete locations; and c) at least partially setting said polymeric resin material.

2. A method as claimed in claim 1 wherein said droplets have a nominal diameter of $10\mu$ (10 microns) or more.

3. A method as claimed in claim 1 wherein steps b) and c) are performed sequentially on successive bands extending widthwise across said base substrate.

4. A method as claimed in claim 1 wherein steps b) and c) are performed sequentially on successive strips extending lengthwise around said base substrate.

5. A method as claimed in claim 1 wherein steps b) and c) are performed spirally around said base substrate.

6. A method as claimed in claim 1 wherein said base substrate is woven and in step b), said preselected discrete locations on said base substrate are knuckles formed by lengthwise yarns of said base substrate passing over crosswise yarns.

7. A method as claimed in claim 1 wherein said base substrate is woven and in step b), said preselected locations on said base substrate are knuckles formed by crosswise yarns of said base substrate passing over lengthwise yarns.

8. A method as claimed in claim 1 wherein said base substrate is woven and in step b), said preselected locations on said base substrate are valleys between knuckles formed by lengthwise yarns of said base substrate passing over crosswise yarns.

9. A method as claimed in claim 1 wherein said base substrate is woven and in step b), said preselected locations on said base substrate are valleys between knuckles formed by crosswise yarns of said base substrate passing over lengthwise yarns.

10. A method as claimed in claim 1 wherein said base substrate is woven and in step b), said preselected locations on said base substrate run between two consecutive knuckles formed by lengthwise yarns of said-base substrate passing over crosswise yarns and include the valley therebetween.

11. A method as claimed in claim 1 wherein said base substrate is woven and in step b), said preselected locations on said base substrate run between two consecutive knuckles formed by crosswise yarns of said base substrate passing over lengthwise yarns and include the valley therebetween.

12. A method as claimed in claim 1 wherein, in step b), said polymeric resin material is deposited by a piezojet array comprising at least one computer-controlled piezojet.

13. A method as claimed in claim 1 wherein step b) comprises the steps of:

i) checking in real time the surface of said base substrate to locate the preselected discrete locations and to cause the deposit thereon of said polymeric resin material to build up said discrete, discontinuous elements; and ii) depositing said polymeric resin material onto said preselected locations requiring polymeric resin material to give said elements the desired height.

14. A method as claimed in claim 13 wherein said checking step is performed by a fast pattern recognizer (FPR) processor operating in conjunction with a digital-imaging camera in real time.

15. A method as claimed in claim 14 wherein said depositing step is performed by a piezojet array coupled to said FPR processor.

16. A method as claimed in claim 1, wherein said polymeric resin material is selected from the group consisting of:

1. hot melts and moisture-cured hot melts;
2. two-part reactive systems based on urethanes and epoxies;
3. photopolymer compositions consisting of reactive acrylated monomers and acrylated oligomers derived from urethanes, polyesters, polyethers, and silicones; and
4. aqueous-based latexes and dispersions and particle-filled formulations including acrylics and polyurethanes.

17. A method as claimed in claim 1 wherein said curing step is performed by exposing said polymeric resin material to a heat source.

18. A method as claimed in claim 1 wherein said curing step is performed by exposing said polymeric resin material to cold air.

19. A method as claimed in claim 1 wherein said curing step is performed by exposing said polymeric resin material to actinic radiation.

20. A method as claimed in claim 12 wherein said piezojet array comprises a plurality of individual computer-controlled piezojets, and wherein some of said individual computer-controlled piezojets deposit one polymeric resin material while other individual computer-controlled piezojets deposit a different polymeric resin material.

21. A method as claimed in claim 1 further comprising the optional step of abrading said polymeric resin material deposited on said base substrate to provide said polymeric resin material above the surface plain of said base substrate with a uniform thickness.

22. A method as claimed in claim 1 wherein a first polymeric resin material is deposited and a second polymeric resin material is deposited which is different from the first polymeric resin material.

23. A papermaker's or industrial fabric comprising:

a base substrate taking the form of an endless loop having a backside and a paper-contacting side; and a plurality of discrete, discontinuous elements of polymeric resin material, said discreet, discontinuous elements comprising a plurality of droplets at preselected discrete locations on said backside, said elements having a height of about 0.5 mm relative to said backside.

24. A papermaker's or industrial fabric as claimed in claim 23 wherein said base substrate is woven from lengthwise and crosswise yarns and wherein said preselected locations are knuckles formed by said yarns on said backside.

25. A papermaker's or industrial fabric as claimed in claim 23 wherein said base substrate is woven from lengthwise and crosswise yarns and wherein said preselected locations are valleys between knuckles formed by said yarns on said backside.

26. A papermaker's or industrial fabric as claimed in claim 23 wherein said base substrate is woven from lengthwise and crosswise yarns and wherein said preselected locations encompass at least two consecutive knuckles formed by said yarns on said backside and the valleys in between.

27. A papermaker's or industrial fabric as claimed in claim 23 wherein said fabric is a dryer fabric.

28. A papermaker's or industrial fabric as claimed in claim 23 wherein said base substrate is a spiral-link belt.

* * * * *